US012594506B2

(12) United States Patent
Lechevalier

(10) Patent No.: US 12,594,506 B2
(45) Date of Patent: Apr. 7, 2026

(54) BEND ELEMENT FOR A WATERSLIDE

(71) Applicant: ATELIER F FZ LLE, Fujairah (AE)

(72) Inventor: Arthur Lechevalier, Argenteuil (FR)

(73) Assignee: ATELIER F FZ LLE, Fujairah (AE)

( * ) Notice: Subject to any disclaimer, the term of this patent is extended or adjusted under 35 U.S.C. 154(b) by 134 days.

(21) Appl. No.: 18/292,629

(22) PCT Filed: Aug. 12, 2022

(86) PCT No.: PCT/IB2022/057532
§ 371 (c)(1),
(2) Date: Jan. 26, 2024

(87) PCT Pub. No.: WO2023/017472
PCT Pub. Date: Feb. 16, 2023

(65) Prior Publication Data

US 2025/0090968 A1 Mar. 20, 2025

(30) Foreign Application Priority Data

Aug. 12, 2021 (EP) ..... 21020411

(51) Int. Cl.
*A63G 21/18* (2006.01)

(52) U.S. Cl.
CPC ..... *A63G 21/18* (2013.01)

(58) Field of Classification Search
CPC ..... A65G 21/18
(Continued)

(56) References Cited

U.S. PATENT DOCUMENTS 5,011,134 A * 4/1991 Langford ..... A63G 21/18 472/117
5,020,465 A 6/1991 Langford
(Continued)

FOREIGN PATENT DOCUMENTS

CN 211486520 U 9/2020
CN 212818074 U 3/2021
(Continued)

OTHER PUBLICATIONS

International Search Report and Written Opinion of the International Searching Authority dated Sep. 21, 2022, issued in corresponding International Application No. PCT/IB2022/057532 (10 pgs.).

(Continued)

*Primary Examiner* — Joseph A Dillon, Jr.
(74) *Attorney, Agent, or Firm* — Pillsbury Winthrop Shaw Pittman, LLP

(57) ABSTRACT

In a bend element for a flume-type waterslide, the bend element defining a bend with a bent sliding path for a rider between a bend-entry portion and a bend-exit portion of the bend element, wherein the bend element, in an apex region of the bend, has an asymmetric geometry in cross section, in which the radius ($r_2$) in cross section is increased on its outer side, which increased radius ($r_2$) is greater than the radius ($r_1$) in cross section of the bend element on its inner side, the bend-entry portion and the bend-exit portion have axes of entry into the bend and of exit from the bend that cross each other at an inner bend-angle of at least 90°.

19 Claims, 15 Drawing Sheets

Figure 1:
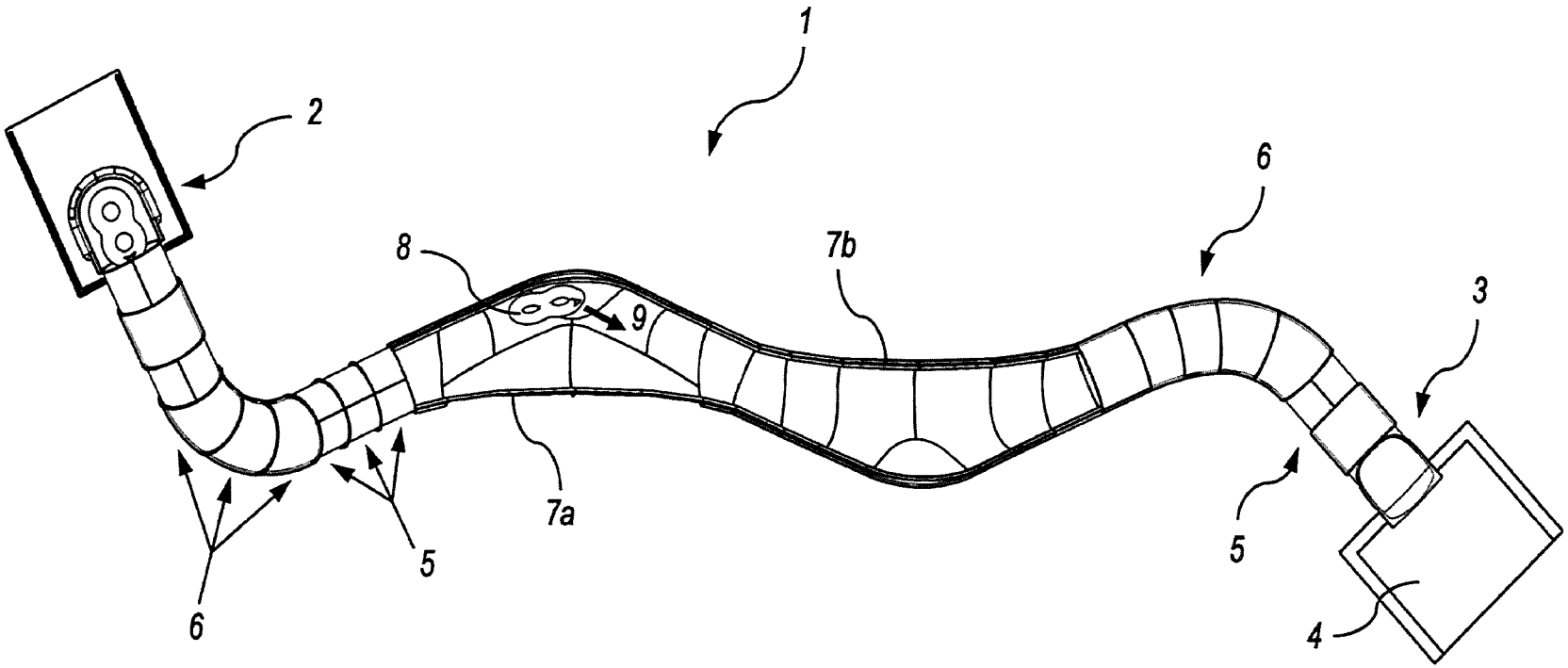

(58) Field of Classification Search
USPC ..... 472/117
See application file for complete search history.

(56) References Cited

U.S. PATENT DOCUMENTS

| | | | | |
|---|---|---|---|---|
| 8,197,353 | B2 * | 6/2012 | Brassard | A63G 21/18 472/117 |
| 9,440,155 | B2 * | 9/2016 | Fischer | A63G 21/10 |
| 9,504,924 | B2 * | 11/2016 | Hunter | A63G 21/18 |
| 10,179,293 | B2 * | 1/2019 | Brassard | A63G 21/18 |
| 11,273,383 | B2 * | 3/2022 | Briggs | A63G 21/18 |
| 11,358,068 | B2 * | 6/2022 | Chutter | A63G 31/007 |
| 2013/0237333 | A1 * | 9/2013 | Brassard | A63G 21/18 472/117 |
| 2014/0206467 | A1 * | 7/2014 | Hunter | A63G 21/00 472/116 |
| 2020/0222818 | A1 * | 7/2020 | Chutter | A63G 21/18 |

FOREIGN PATENT DOCUMENTS

| | | | |
|---|---|---|---|
| JP | H02-213375 | A | 8/1990 |
| WO | 2013/172801 | A1 | 11/2013 |

OTHER PUBLICATIONS

International Preliminary Report on Patentability completed Feb. 16, 2023, issued in corresponding International Application No. PCT/IB2022/057532 (4 pgs.).

* cited by examiner

BEND ELEMENT FOR A WATERSLIDE

CROSS-REFERENCE TO RELATED APPLICATIONS

This application is the US national stage entry of PCT/IB2022/057532, filed Aug. 12, 2022, which claims priority to European Patent Application No. 21020411.1, filed Aug. 12, 2021, the entire contents of both of which are herein incorporated by reference in their entireties.

The present invention relates to a bend element for a flume-type waterslide as well as a waterslide having at least one inventive bend element.

Waterslides of the flume-type are installed as attractions in public open air or indoor swimming pools and water parks where they offer refreshment and excitement alike under safe circumstances. A waterslide of the type disclosed herein is a flume-type waterslide, in which a ride channel or flume is provided with a sliding surface on its inside that is irrigated with considerable amounts of water to reduce friction between a rider or a riding vehicle for one or a plurality of riders to descend the flume sliding over the sliding surface. In cross section the flume usually has a rounded geometry and is oftentimes circular in cross section with an upper portion being open or closed. Geometries having different cross sections than circular are also known, for example elliptic cross sections or rectangular cross sections. The flume forms, hence, an open or closed channel defining the ride path on the sliding surface. The water for irrigation is usually taken from a pool into which the waterslide opens and is pumped upwards to the entry of the waterslide located at a considerable height above the level of the pool. Sliding down the flume causes the rider to slide on the bottom of the flume in straight sections and to slide on the curved wall sections of the flume due to the centrifugal forces experienced in a bend of the flume. Especially the bends of waterslides offer an exciting thrill to riders of all ages.

Where the term "cross section" is used in this specification, it denotes a cross section perpendicular to the longitudinal axis of an element of the water slide or, more importantly, where the element is the inventive bend element, a cross section perpendicular to a tangent of the bend element at the location of the cross section in question.

Waterslides have become known, in which the flume, departing from a circular cross section, is designed with an increased radius of curvature in cross section on an outer side of a bend to allow the rider to be carried further outward in a bend, away from the center of the flume. These bends, in which the radius is increased on the outer side form bends that have an acute inner bend-angle, which bend-angle is defined by the axes of entry into the bend and of exit from the bend that cross each other. This, however, means that a rider comes almost to a complete stop at the top of the apex region with increased radius before accelerating again from the outer dead center back into the direction of the exit from the sharp bend. Such regions of increased radius on the outer side of a sharp bend of an acute inner bend-angle are experienced as particularly joyful and relaxing as the centrifugal forces reduce to a minimum and the bend is therefore experienced less violently than a sharp bend with constant radius in cross section in which the rider experiences rather high centrifugal forces depending on the speed at which the rider is passing the bend. On the other side, the existence of an outer dead center in these sharp turns or bends brings along an almost complete loss of travelling speed and leads to a path of travel for the rider, which can be described as a pendulous ride path, where a series of dead stops is experienced when a series of such bend elements is arranged consecutively. There are also elements with increased radius or diameter in the bend, which are basically formed by a flat outer region that is inclined as compared to the horizontal and which have an acute angle. In these elements of a waterslide, the rider also experiences a complete stop at the outer dead center. Also, the rider tends to experience a pendulous ride path, when exiting from such a bend into a straight or curved section, which delays regaining high travel speeds in the straights. This is also true for bend elements that resemble cones or the like.

The above mentioned recreational facilities thrive to offer ever more exciting and entertaining rides for the visitors and water parks are competing for guests that may choose visiting one water park or another based on the attractions offered there. Hence, there is a great interest in providing more exciting water slides of new types.

It is, therefore, an object of the present invention to provide a bend element for a flume-type waterslide, that offers a better riding experience as compared to conventionally designed bend elements known in the state of the art.

To solve this object, the present invention provides for a bend element for a flume-type waterslide, the bend element defining a bend with a bent sliding path for a rider between a bend-entry portion and a bend-exit portion of the bend element, wherein the bend element, in an apex region of the bend, has a region of asymmetric geometry in cross section, in which the radius in cross section is increased on its outer side, which increased radius is greater than the radius in cross section of the bend element on its inner side, wherein the bend-entry portion and the bend-exit portion have axes of entry into the bend and of exit from the bend that cross each other at an inner bend-angle of at least 90°. Preferably, in a cross section of the bend element, a vertical line intersecting the bottom of the bend element at its lowest point delimits the outer side from the inner side.

Preferably, the cross section of the bend element, in an apex region, comprises an outer bottom section and an inner bottom section, wherein the outer bottom section extends from the lowest point in an outward direction to an outer point, in which the outer bottom section (or its tangent line) has an inclination of 45°, preferably 30°, more preferably 20°, relative to the horizontal, and wherein the inner bottom section extends from the lowest point in an inward direction to an inner point that has the same distance from the lowest point, measured in the vertical direction, as the outer point.

In one embodiment, the outer bottom section has a radius of curvature that is greater than the radius of curvature of the inner bottom section.

In another embodiment, the inner bottom section does not have any radius of curvature that is greater than any radius of curvature of the outer bottom section.

In another embodiment, the perpendicular distance between the outer point and the vertical line separating the outer side from the inner side is larger, e.g., by a factor of at least 1.2, preferably at least 1.5, than the perpendicular distance between the inner point and said vertical line.

So, the concept of the present invention is to increase the diameter of the bend element in the apex region on its outer side as compared to the shape of the cross section in a bend-entry portion and a bend-exit portion to make it possible for the rider to slide more to the outside of the bend, while, crucially, avoiding deceleration due to an acute bend angle. By the inventive bend element, it becomes feasible to build waterslides offering the experience of almost zero gravity and zero centrifugal forces in the apex region of the bend element while at the same time preserving the speed which is, of course, also a vital factor for an exciting ride. As opposed to the bend element of the present invention, bend elements known from the state of the art, when having an increased radius in cross section on their outer side in an apex region compared to their inner side, have an inner bend-angle which is smaller than 90° and often, the inner bend-angle of these bend elements is close to 0° (such as 10° or 15°) so that a more or less full stop of the rider occurs when the rider passes theses bends. In any case, inner bend-angles of less than 90° bring about an oscillating movement of a rider or ride vehicle with acute upper dead centers, which is not desired by the present invention. The inventive bend element, due to its large inner bend-angle provides for a smooth ride that follows a somewhat sinusoidal curve through the bend element when a plurality, such as at least two or three inventive bend elements, are arranged consecutively with alternating bending directions.

In the context of the present invention, the radius or the radii on the outer side of the bend can be increased to be infinitely large, thereby defining a flat region in the apex region in cross section on the outer side of the inventive bend element as it is in conformity with a preferred embodiment.

Within the present description and claims, the terms "inner side" and "outer side" refer to the sides of the curvature of the bend, i.e., a radially inner region is referred to as "inner side" and a radially outer region is referred to as "outer side". In particular, in a cross section of the bend element, a vertical line intersecting the bottom of the bend element at its lowest point delimits the outer side from the inner side.

Also, the terms "apex region", "region of the apex" and, generally, the term "apex" denotes the apex of the bend, this being the geometrical center of the bend where the axes of entry and exit cross or intersect each other.

It is to be noted that, in the present application, whenever regions of different geometries and in particular of different radiuses in cross sections are mentioned, it is to be understood that there may never be a sudden change of radius but the radiuses from one region to another changes smoothly without any geometrical discontinuity as this would cause an edge in the sliding path which could cause serious injuries to a rider. Also, the increased radius on the outer side may be a plurality of radii being larger than a plurality of radii on the inner side. This means that the outer side and the inner side may not be perfectly circular in cross section but surely have a narrower curvature in cross section on the inner side and a more open curvature in cross section on the outer side.

The inventive bend element of the present invention, therefore, resembles a dish of asymmetrical geometry in cross section with a rather open side toward the outer side of the bend defined by the inventive bend element and a more closed, circular geometry on the inner side, which inner side, however is never touched by a rider travelling through the bend at speed. Crucially, the inner bend-angle is an obtuse angle to keep the rider from losing significant speed in the bend and to cause a sinusoidal ride path or path of travel of a rider inside the flume.

Preferably, the inner bend-angle is chosen between 100° and 160°, preferably between 110° and 150°, more preferably between 120° and 140° and most preferably at 135°.

In order to ensure the safety of a rider riding the inventive bend element, and in conformity with a preferred embodiment of the present invention, the region of the apex on the outer side extends higher than the height of the flume in the bend-entry portion or the bend-exit portion and, preferably, extends to at least twice the height as compared to the height of the flume in the bend-entry portion or the bend-exit portion. This allows a rider to travel through the inventive bend element at high speed and to be carried upwards in the region of the apex without having to fear to fall out of the flume. In addition, the inventive bend element, on its outer side, may have an additional edge element, that is inclined towards the inner side of the bend to add even more safety.

According to a preferred embodiment, the present invention is characterized in that the inner side of the bend element has a bend radius which is greater than the bend radius of the outer side of the bend element. This means that the inner side of the bend element has an edge straighter than the inner bend-angle between the axes of entry into the bend and of exit from the bend would require so that the inner portion of the bend element becomes larger in diameter. This gives a rider a feeling of traveling through a larger space.

To even increase this feeling of space, the present invention is preferably devised in such a manner that in the apex region the bend element is made from translucent material at least on the inner side of the bend element. This is particularly thrilling as a rider gets the illusion of flying or having to fear to fall down from the waterslide while, in fact, the rider is perfectly safe. This preferred feature also offers a view into the slide for people standing by which might motivate them to actually use and ride the waterslide.

While a waterslide of the initially mentioned type is usually made up from a multitude of straight elements and bend elements, a bend element itself can also be characterized in that the bend element is made up of a plurality of segments of mirrored geometry with respect to a line extending from the apex to the center of curvature as it is in conformity with a preferred embodiment of the present invention. Building the inventive bend element from a plurality of segments facilitates its production as smaller pieces of the bend element have to be handled. Making them of mirrored geometry makes tooling for the segments to be produced easier.

The present invention may preferably also be characterized in that the apex region of the bend is made from a single segment arranged symmetrically between the segments of mirrored geometry. This allows to insert different apex segments based on the velocity to be expected from the rider in a particular inventive bend element.

According to a preferred embodiment, the present invention is characterized in that the height of the flume on its outer side is maximum in a region following the apex towards the bend-exit portion. This is to allow for an extra margin of sliding surface in case of high velocity of the rider so that the rider will not bump against the outer edge of the flume.

A further preferred embodiment of the present invention provides for a bend element that has an increase in slope in in a region extending from the region of the apex towards the bend-exit portion. This means that the sliding path drops down after the region of the apex so that a rider will experience the feeling of dropping right after passing the apex of the bend element. This can provide extra speed for the next element.

As already mentioned, it is required to provide considerable amounts of water to the flume-type waterslide in order to allow a rider to slide down the flume with very little friction. In straight sections of the waterslide and also in bend regions of the waterslide that have a circular cross section or at least no regions of increased radius as in the present invention, water flowing from the top of the slide to the bottom will naturally follow the slide path of a rider as it is subjected to the centrifugal forces in the bends and will, therefore, irrigate the flume in the regions necessary for fast travel of a rider. However, when the outer region of a bend becomes flat due to an increased radius in cross section, as it is in conformity with the present invention, the water flowing from the top of the slide to the bottom will not have enough kinetic energy to reach the outer parts of the apex region which are easily reached by a much heavier rider. When passing the apex region of the bend, where riders may leave the stream of water flowing from the top of the slide to the bottom, they will re-enter the stream of water and most likely be decelerated when splashing into the stream of water.

To counter for this fact, the present invention is preferably devised in such a manner, that the bend element has a plurality of water-draining holes in a bottom area thereof. This will eliminate almost all of the stream of water flowing from the top of the slide to the bottom and the rider will not splash into a slower stream of water and therefore will not be decelerated. In the region of the water-draining holes, the stream of water flowing from the top of the slide to the bottom will be directed to a channel under the sliding surface of the bend element and directed to emerge at the end of one single bend element or a series of consecutively arranged bend elements according to the present invention to provide the desired low friction in the remainder of the path of travel through the waterslide.

While the provision of water-draining holes in the inventive bend element provides for an unhindered travel through the bend without splashing into the slower stream of water, precautions need to be taken to avoid actually dry spots on the inner surface of the inventive bend element. Dry spots or regions would decelerate a ride vehicle or may lead to serious burns on the skin of a rider travelling over these dry areas without a ride vehicle as friction becomes very high. The present invention is, therefore, preferably devised in such a manner that at least one irrigation element, preferably a plurality of irrigation elements, is arranged on the outer side of the bend element outside the sliding path. Preferably there is a plurality of irrigation elements arranged on the outer side of the bend element outside the sliding path to fully irrigate the bend element in all regions necessary. The irrigation elements, however, provide only for a thin film of water which does not hinder or decelerate the rider.

The waterslide of the present invention is characterized by having at least one bend element according to the invention. Preferably the waterslide has a plurality of the inventive bend elements. Preferably, the plurality of bend elements comprise bend elements having alternating directions of bend or curve being arranged consecutively. This makes the rider travel along a somewhat sinusoidal travel path.

Figure 4:
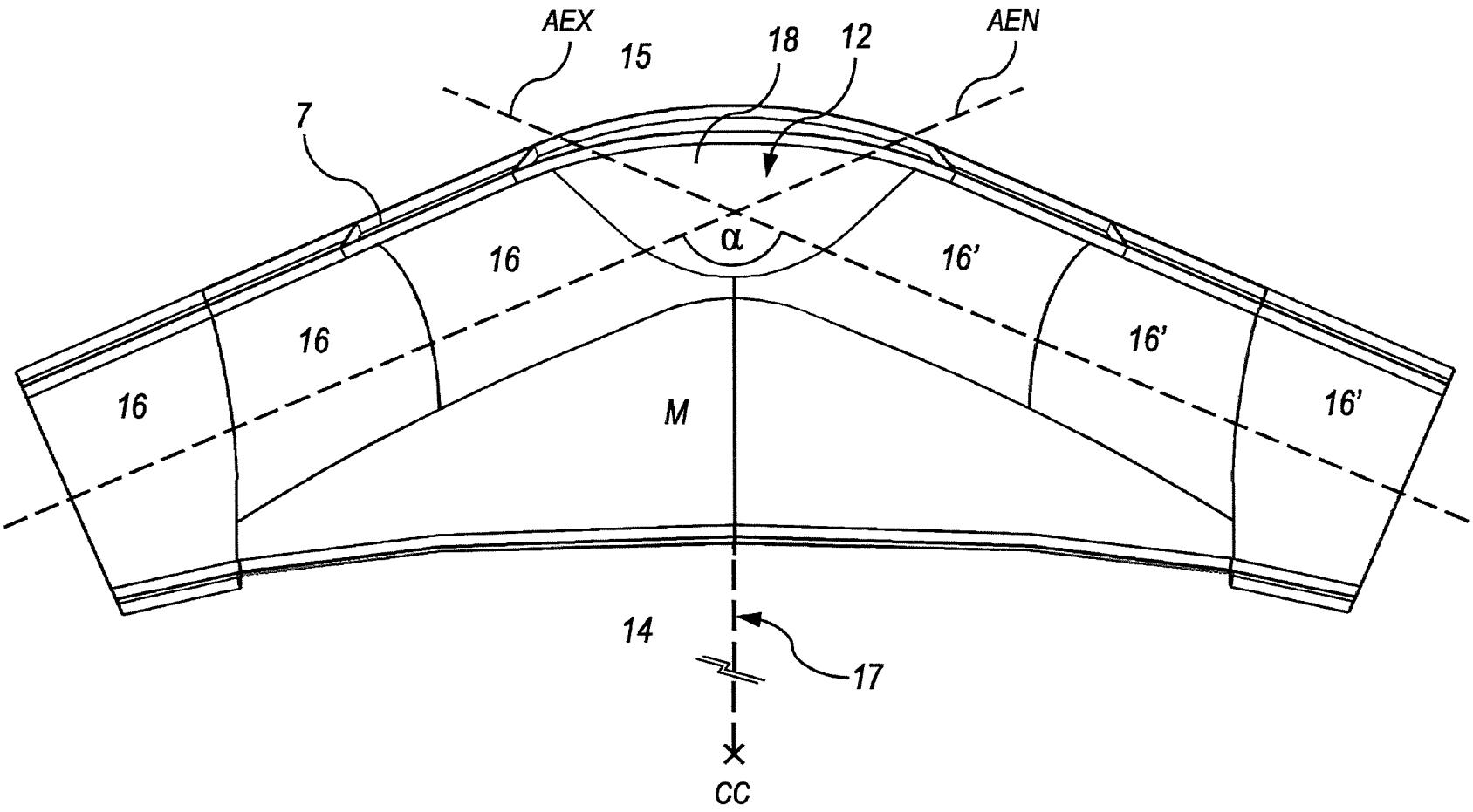
Figure 5:
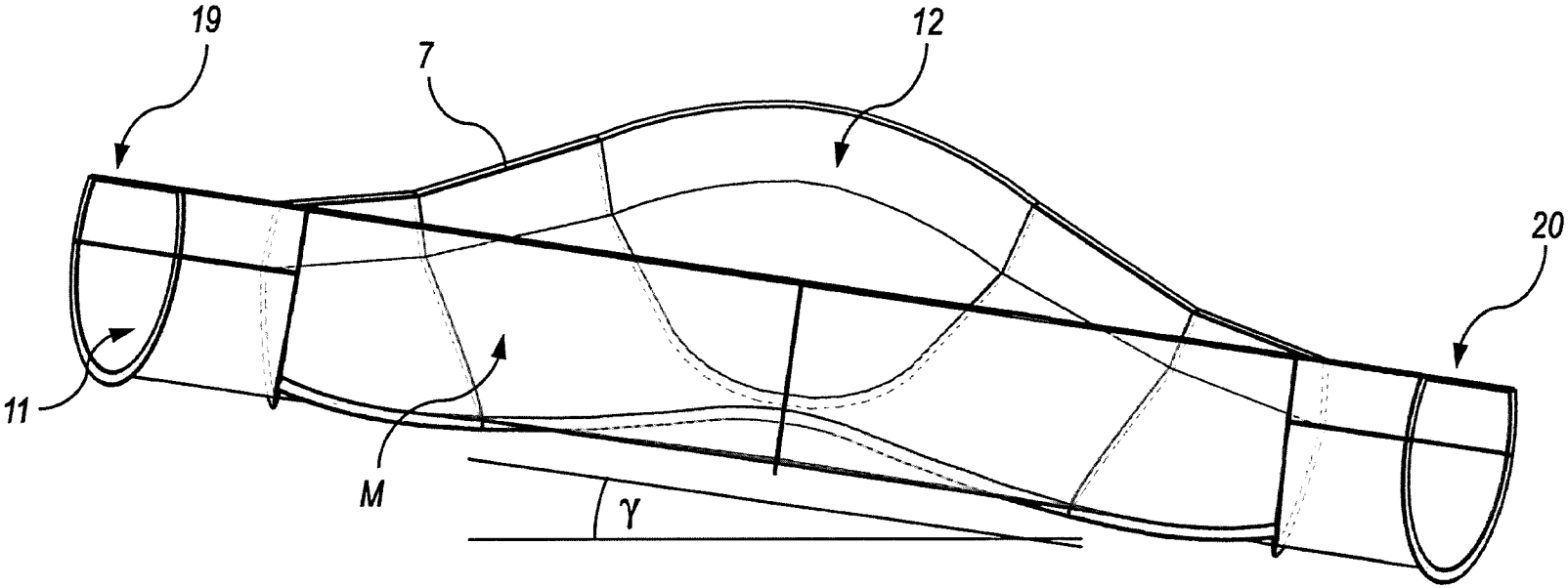
Figure 6:
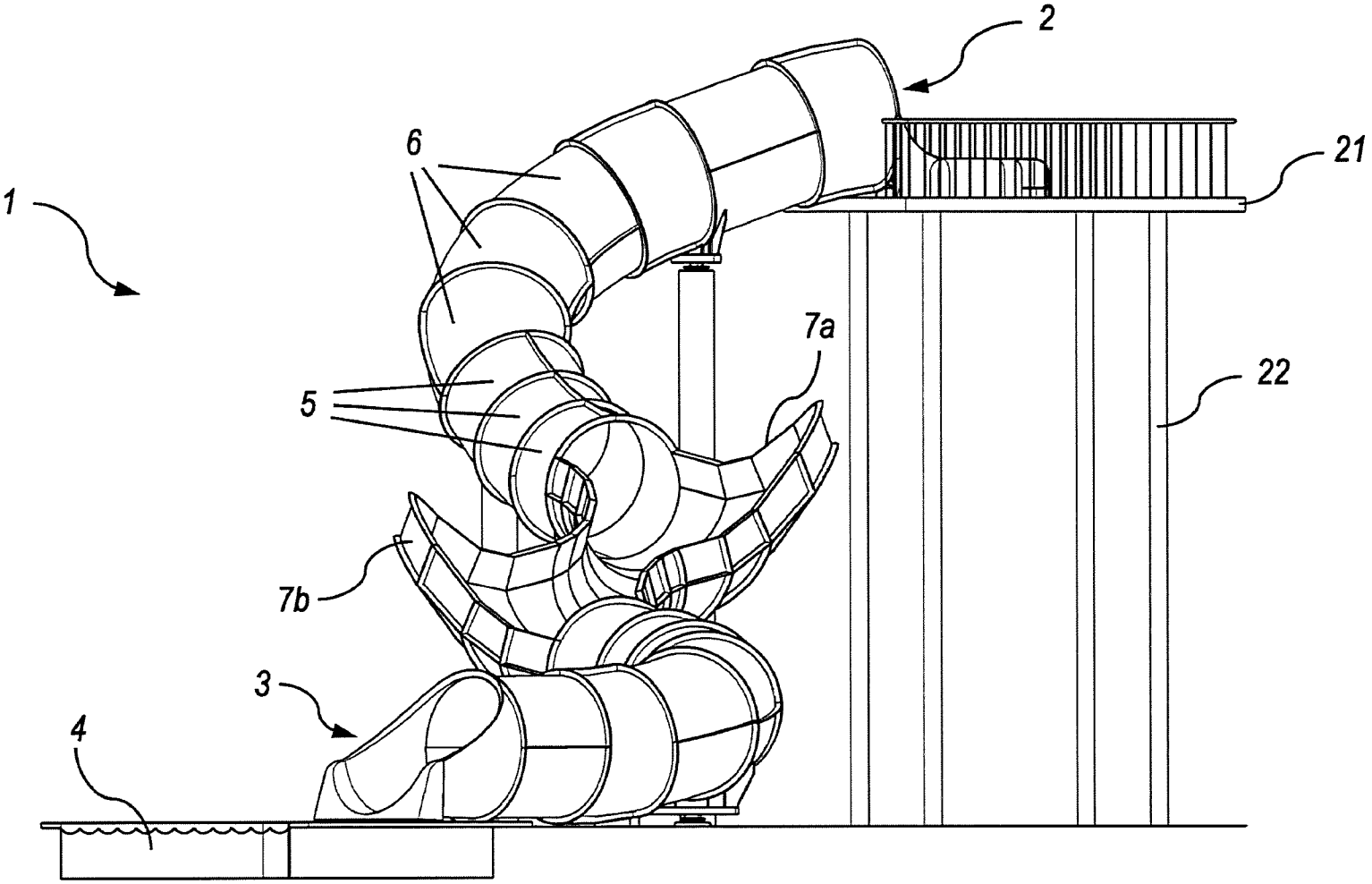
Figure 10:
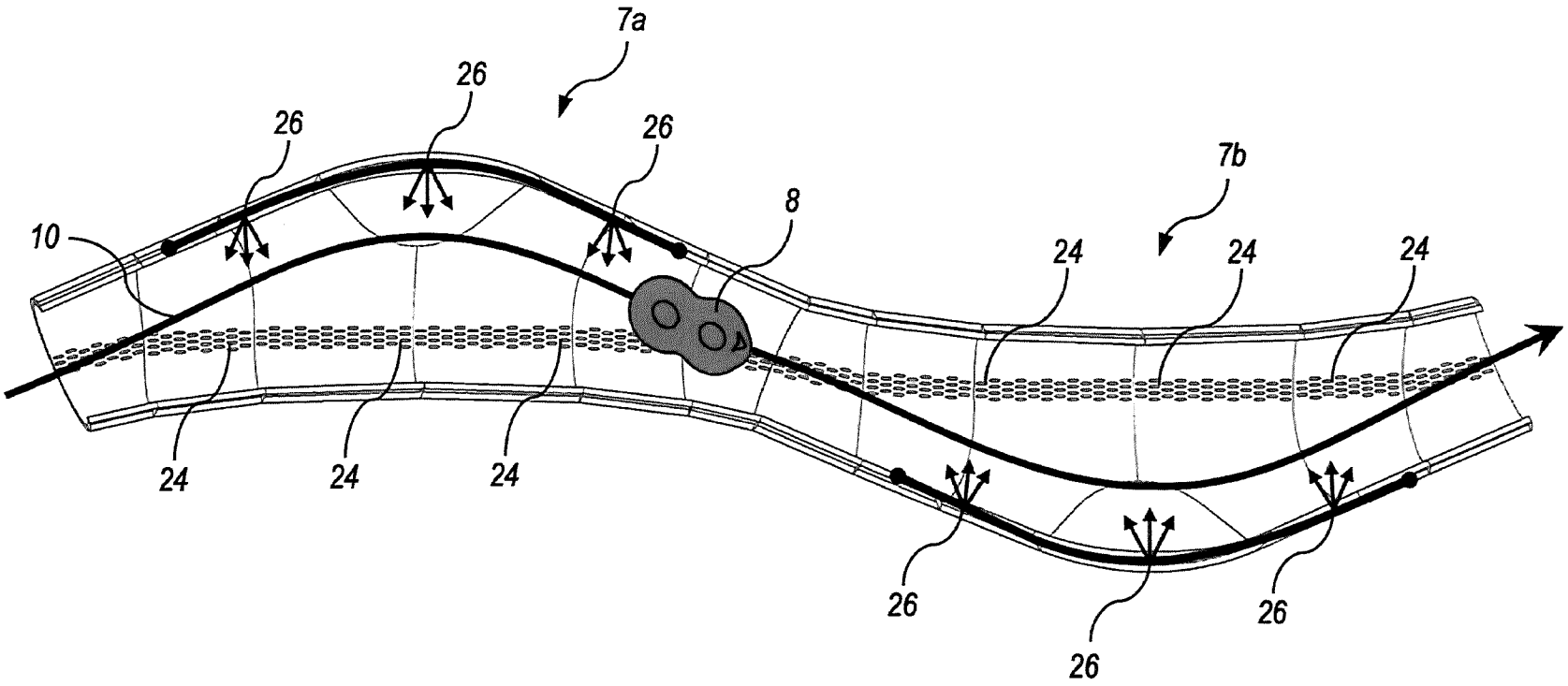
Figure 11:
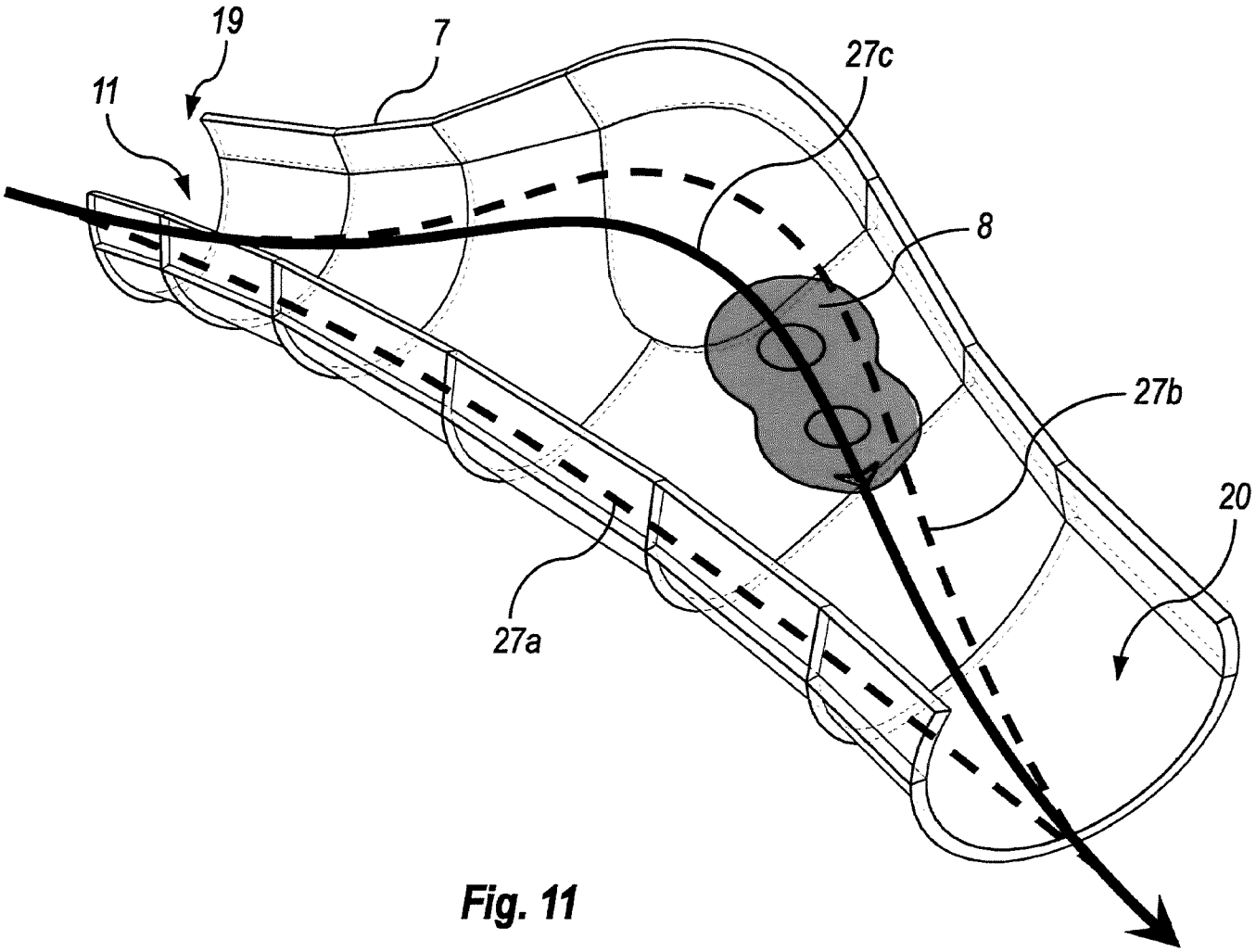
Figure 12:
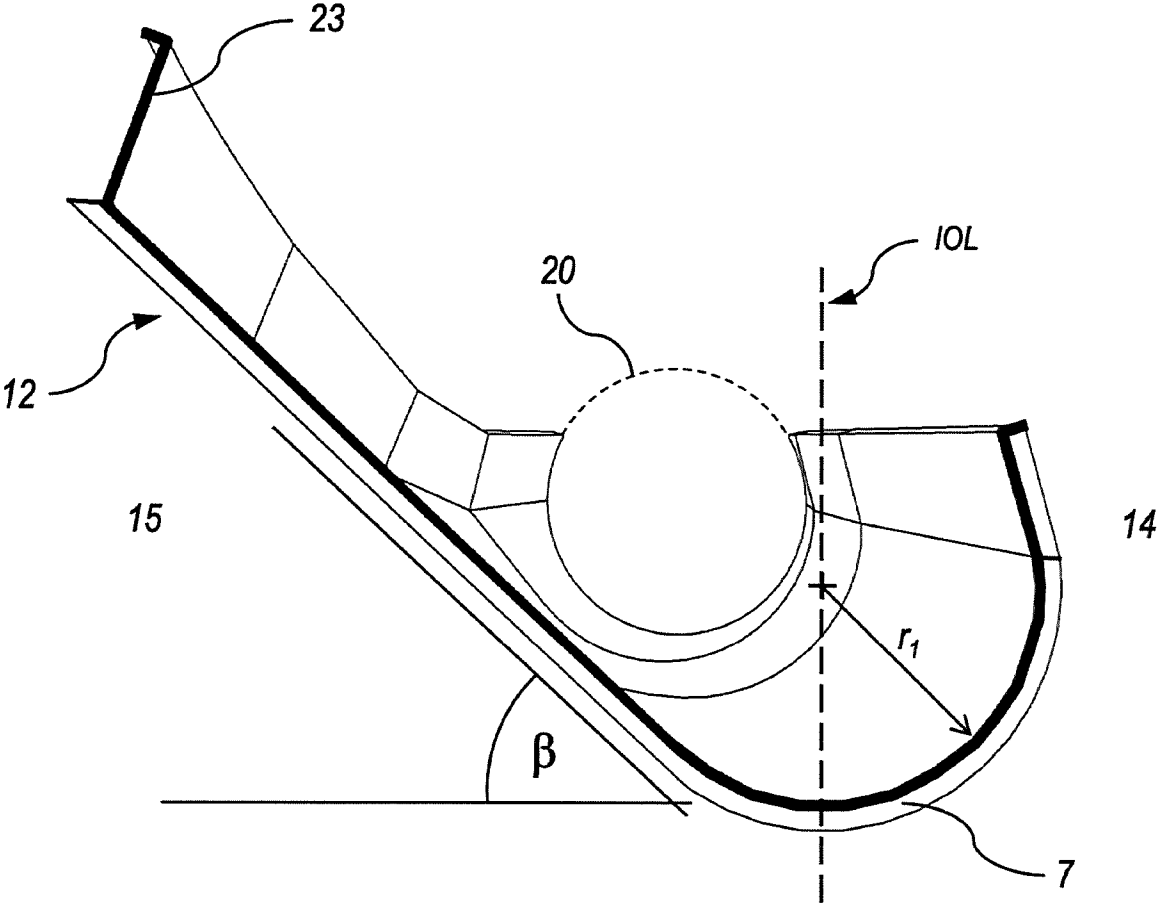
Figure 13:
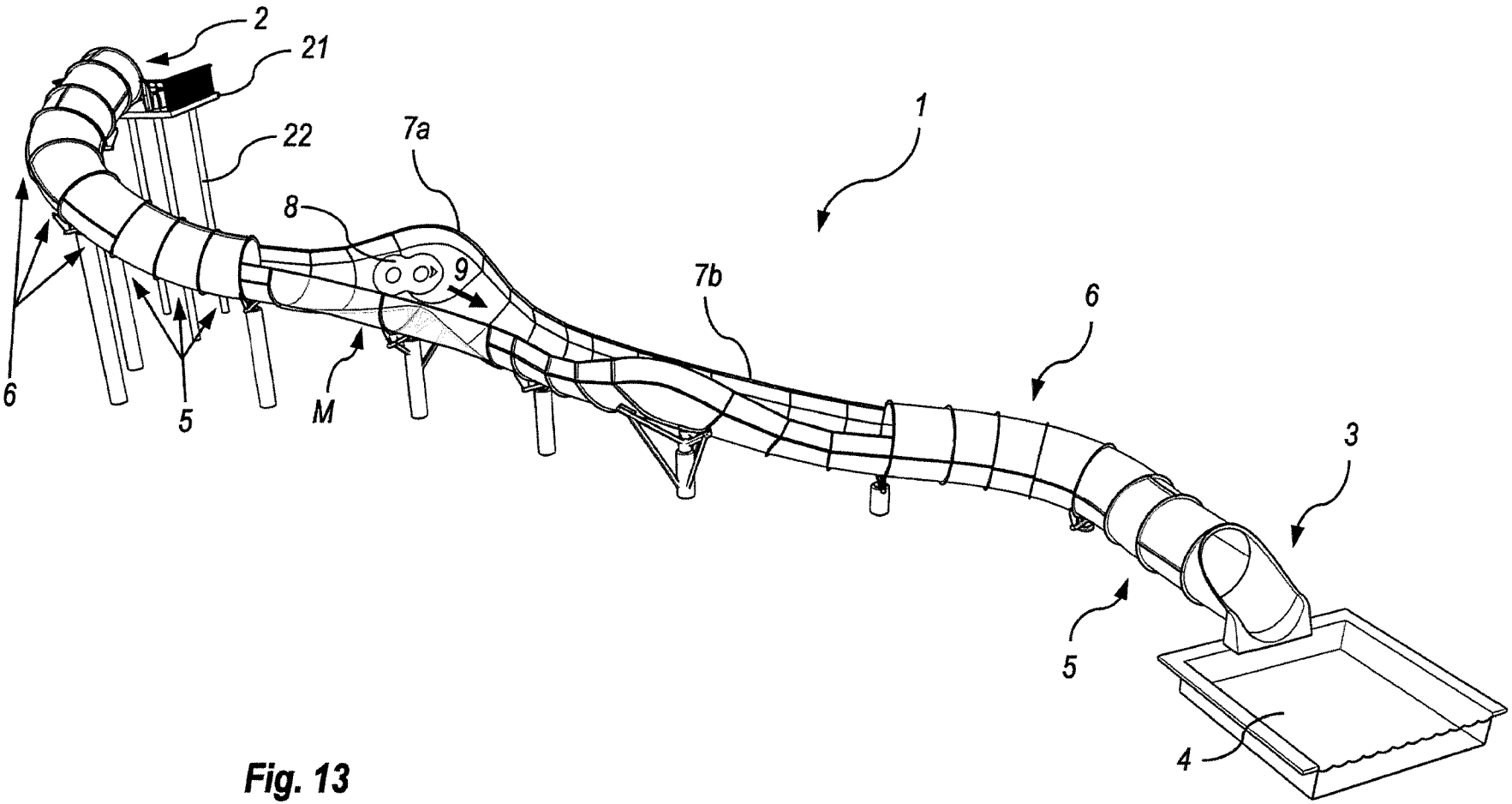
Figure 14:
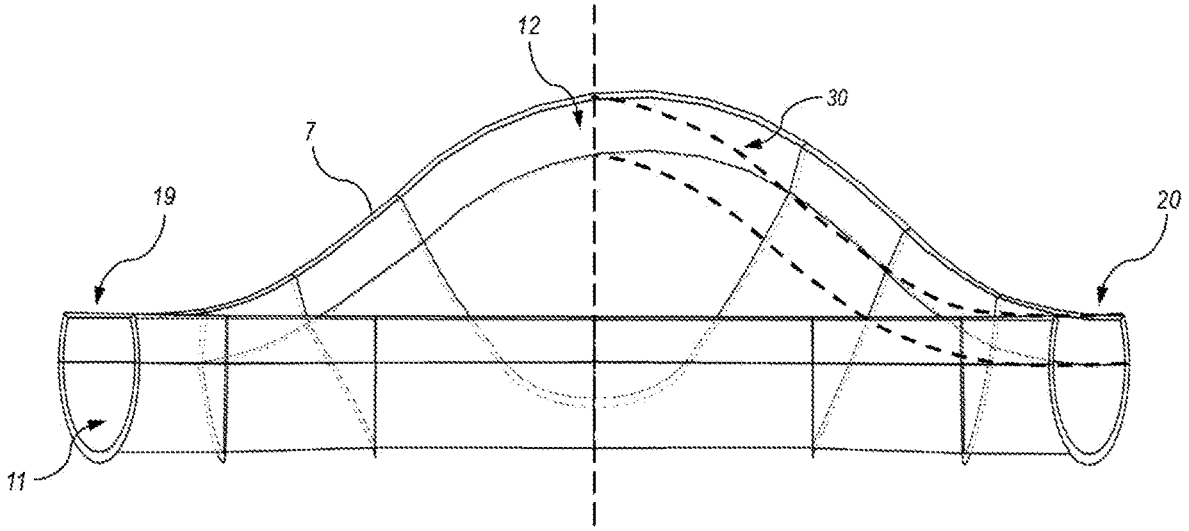
Figure 15:
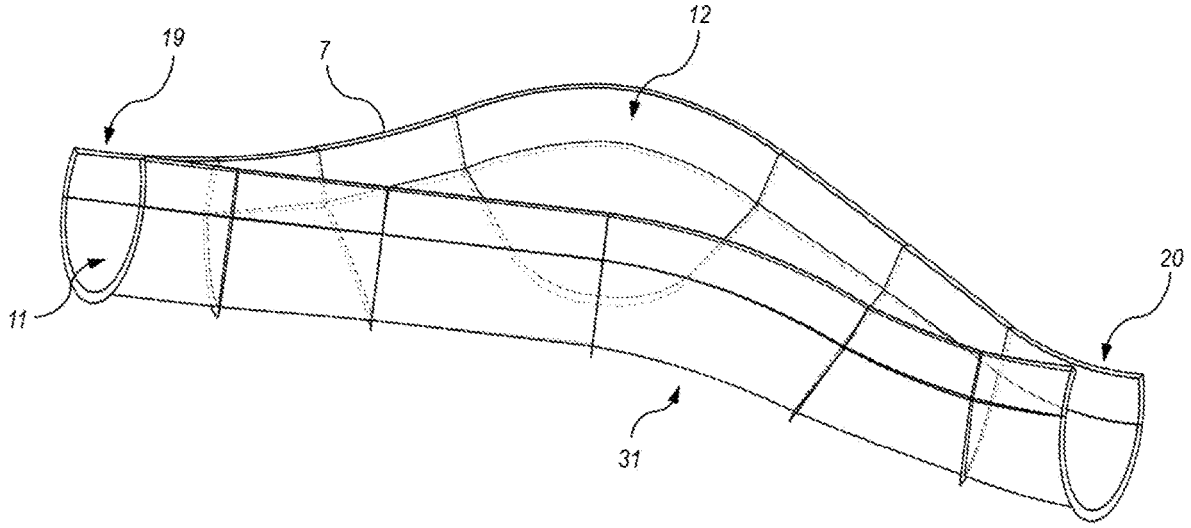

The present invention will now be exemplified in more detail by way of an exemplary embodiment shown in the drawing. In the drawing, FIG. 1 shows a plan view of in inventive waterslide, FIG. 2 shows a ride path of a riding vehicle for a rider inside two consecutive inventive bend elements, FIG. 3 shows an inventive bend element in cross section, FIG. 4 shows an inventive bend element in top view, FIG. 5 shows an inventive bend element in an elevational view, FIG. 6 shows an inventive waterslide, FIGS. 7 to 10 elucidate the structure as well as function and effects of a water-draining system in an area of a waterslide having inventive bend elements, FIG. 11 shows different ride path or travel paths through an inventive bend element, FIG. 12 shows an inventive bend element according to an alternative within the scope of the present invention, FIG. 13 is a perspective view of the inventive water slide according to FIG. 1, FIG. 14 shows a bend element in an elevational view with an increase height on the outer side after the apex region and FIG. 15 is an elevational view of an inventive bend element having a drop after the region of the apex.

In FIG. 1, a waterslide according to the present invention is denoted by reference numeral 1. The waterslide 1 is made of an entry 2 and an exit 3 opening into a pool 4, wherein the entry 2 is located at a higher elevation than the exit 3 in order to obtain a slope for a rider to slide down. The waterslide 1 further consists of straight elements 5, bend elements 6 with circular cross sections according to the state of the art and of two inventive bend elements 7*a* and 7*b*. The straight elements 5 are usually only straight in a top view in the sense of not having an inner bend-angle but may be curved in an elevational view to further accelerate the rider before entering an inventive bend elements 7*a* and 7*b* in order to reach sufficient speed to be able to slide through the inventive bend elements 7*a* and 7*b* and to reach the outer side of the bend element 7*a* and 7*b* to experience the intended sensation. A ride vehicle 8 for two riders (riders not depicted) is shown as travelling down the waterslide 1 in the sense of arrow 9. A ride vehicle 8 may also be devised for one rider only or for more than two riders, such as three, four, five, six seven or even eight riders. In principle, the size and holding capacity of the ride vehicle is solely limited by the size of the waterslide itself.

Figure 2:
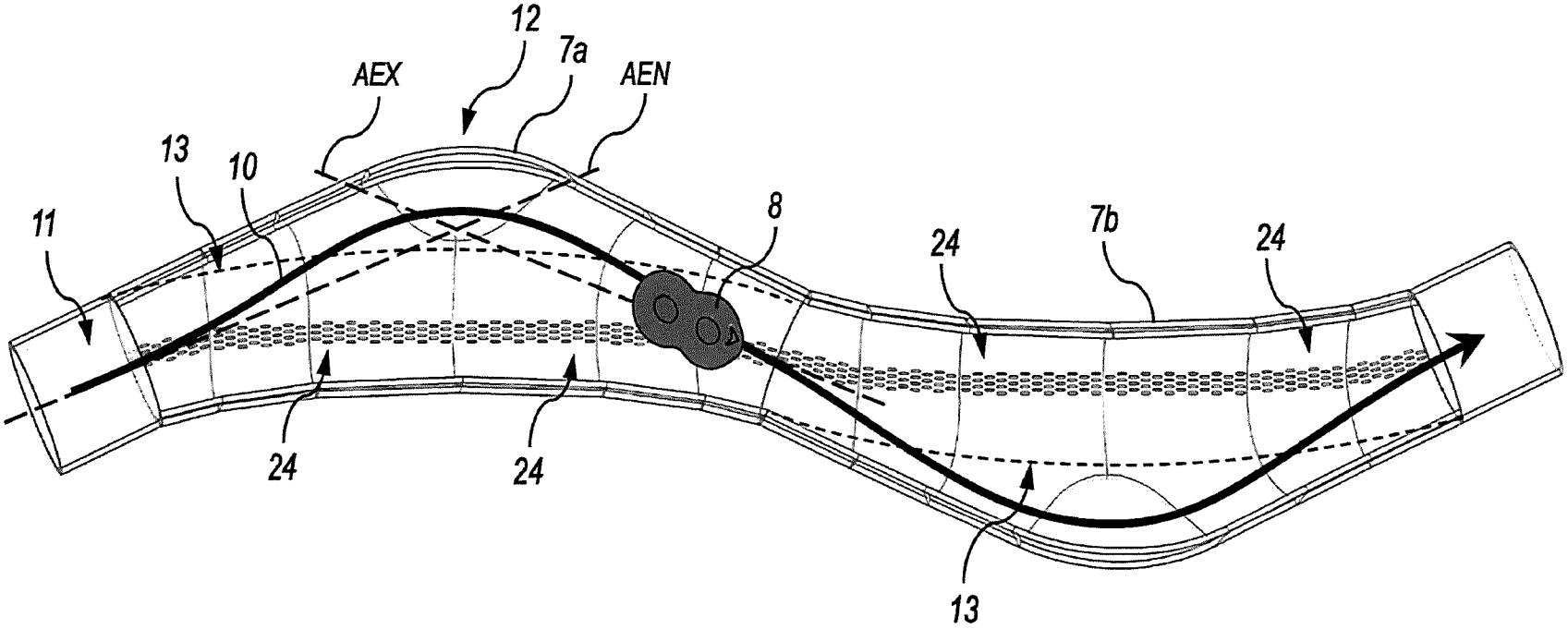

In FIG. 2 the ride path 10 is drawn as a strong line along which the vehicle 8 would travel when passing through the bend elements 7*a* and 7*b*. It can be seen that the ride vehicle 8 due to the inventively increased radius in cross section of the flume 11 in the apex region 12 of the bend can travel further to the outer sides of the bend elements 7*a* and 7*b* then it could in a normal circular cross section-bend element, whose imaginary boundaries are depicted by dashed lines 13. Actually, the rider will follow a sinusoidal travel path when riding through the inventive bend elements 7*a* and 7*b* that are arranged in alternative directions consecutively. The axis of entry into the bend is denoted by AEN and the axis of exit from the bend is denoted by AEX. In FIG. 2, a multitude of water-draining holes 24 in the bottom area of the flume 11 can be seen. These holes 24 together form a drainage system for draining water running down the flume to a channel under these holes 24 in order to eliminate most of the stream of water for the purposes explained above.

Figure 3:
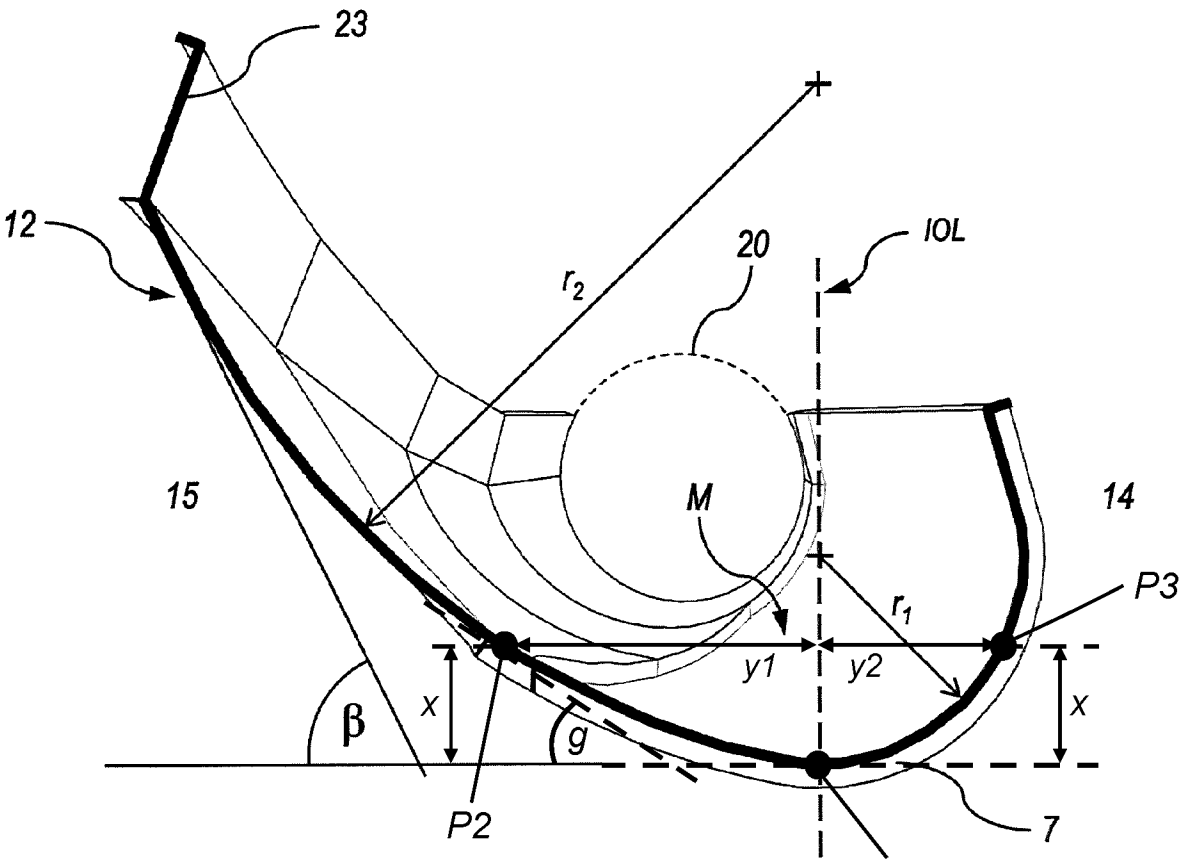

The increased radius in cross section on the outer side of an inventive bend element 7 in an apex region 12 of the bend can be seen in FIG. 3. While the radius $r_1$ of curvature on the inner side 14 of the bend element 7 is relatively small, the radius $r_2$ of curvature on the outer side 15 of the bend element is increased, i.e. is larger and opens the bend element to a sort of dish for a rider to ride when passing the bend element. The inventive bend element 7, thus, has a region of asymmetric geometry in cross section. The bottom of the dish is inclined at an angle β of about 60° to the horizontal at its highest location. This angle may, however, also be smaller or greater and values of 15° to 90° may commonly be provided for. Also in FIG. 3 it can be seen that the bend exit portion 20 has a circular geometry and that in the apex region 12 the bend element 7 is made from translucent material M at least on the inner side 14 of the bend element 7. The inner side 14 and the outer side 15 are delimited, for the purpose of the present specification, by dashed line IOL, which intersects the lowermost line of the bend element 7 and runs vertically. An edge element that is inclined towards the inner side 14 of the bend to add even more safety is denoted by reference numeral 23.

As seen in FIG. 3, the cross section of the bend element, in an apex region, comprises an outer bottom section and an inner bottom section, wherein the outer bottom section extends from the lowest point P1 in an outward direction to an outer point P2, in which the outer bottom section (or its tangent line) has an inclination g of, e.g., 20-45°, relative to the horizontal, and wherein the inner bottom section extends from the lowest point P1 in an inward direction to an inner point P3 that has the same distance x from the lowest point P1, measured in the vertical direction, as the outer point P2. The outer bottom section has a greater radius of curvature (is less curved) than the inner bottom section, so that the perpendicular distance y1 between the outer point P2 and the vertical line IOL is larger than the perpendicular distance y2 between the inner point P3 and said vertical line IOL.

FIG. 4 elucidates that the bend element 1 is made up of a plurality of segments 16 and 16' of mirrored geometry with respect to a line 17 extending from the apex 12 to the center of curvature CC (not shown to scale). Also, it can be seen that the curvature of the inner side 14 of the bend element 7 has a bend radius which is greater than the bend radius of the outer side 15 of the bend element 1. The apex region 12 of the bend is made from a single segment 18 arranged symmetrically between the segments 16, 16' of mirrored geometry. The axes of entry AEN into the bend and of exit AEX from the bend cross each other at an inner bend-angle $\alpha$ of 135°.

In the elevational view of FIG. 5 one will appreciate that, in this example, the region 12 of the apex extends to about twice the height as compared to the height of the flume 11 in the bend-entry portion 19 or the bend-exit portion 20. As described before, the height may also be lower or even higher than twice the height as compared to the height of the flume 11 in the bend-entry portion 19 or the bend-exit portion 20. Also, the bend element 7 is arranged at a defined inclination or slope to the horizontal as symbolized by the angle $\gamma$ which may be in a region of, for example 10% to 60%. This ensures that the rider has the right speed for an exciting ride.

In FIG. 6 the waterslide can be seen as descending from a location of higher elevation such as, for example, provided by a platform 21 on a scaffold 22 to a location of lower elevation as depicted by the pool 4. The bend elements 6 and the straight elements 5 may be covered also on the top and open into the two inventive bend elements 7*a* and 7*b* arranged consecutively. As can clearly be seen, a rider would be able to slide high up into the region of the apex of the bends.

Figure 7:
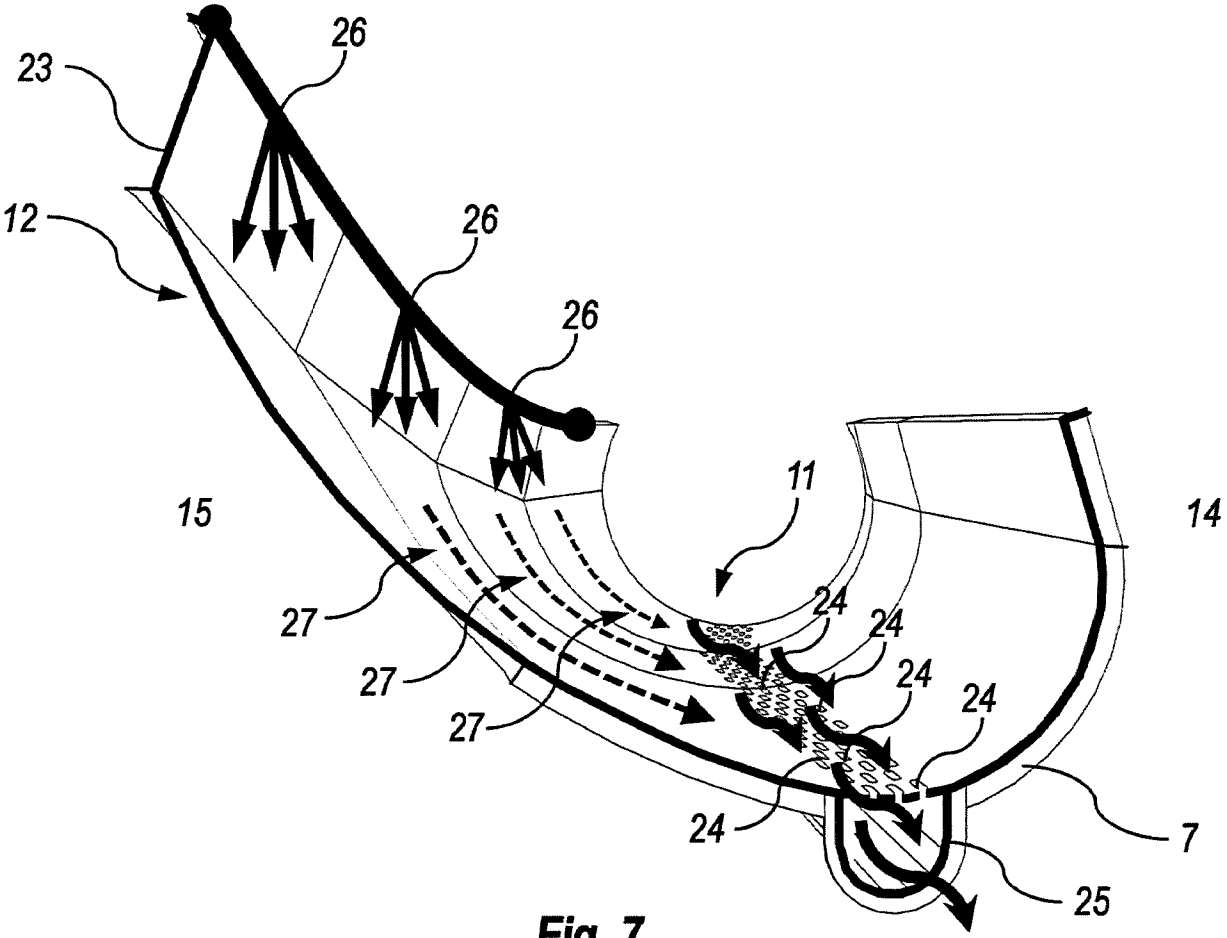

As can be seen in FIG. 7, the inventive bend element may have a multitude of water-draining holes 24 in the bottom area thereof in order to drain the stream of water running down the flume 11 into a channel 25 arranged underneath the holes 24. A plurality of irrigation elements 26 is arranged on the outer side 15 of the bend element 7 outside the sliding path which irrigation elements 26 serve to spray the outer portion of the bend element with a fine spray of water to avoid dry spots or areas. The water from the irrigation elements runs down as a thin film as depicted by arrows 27.

Figure 8:
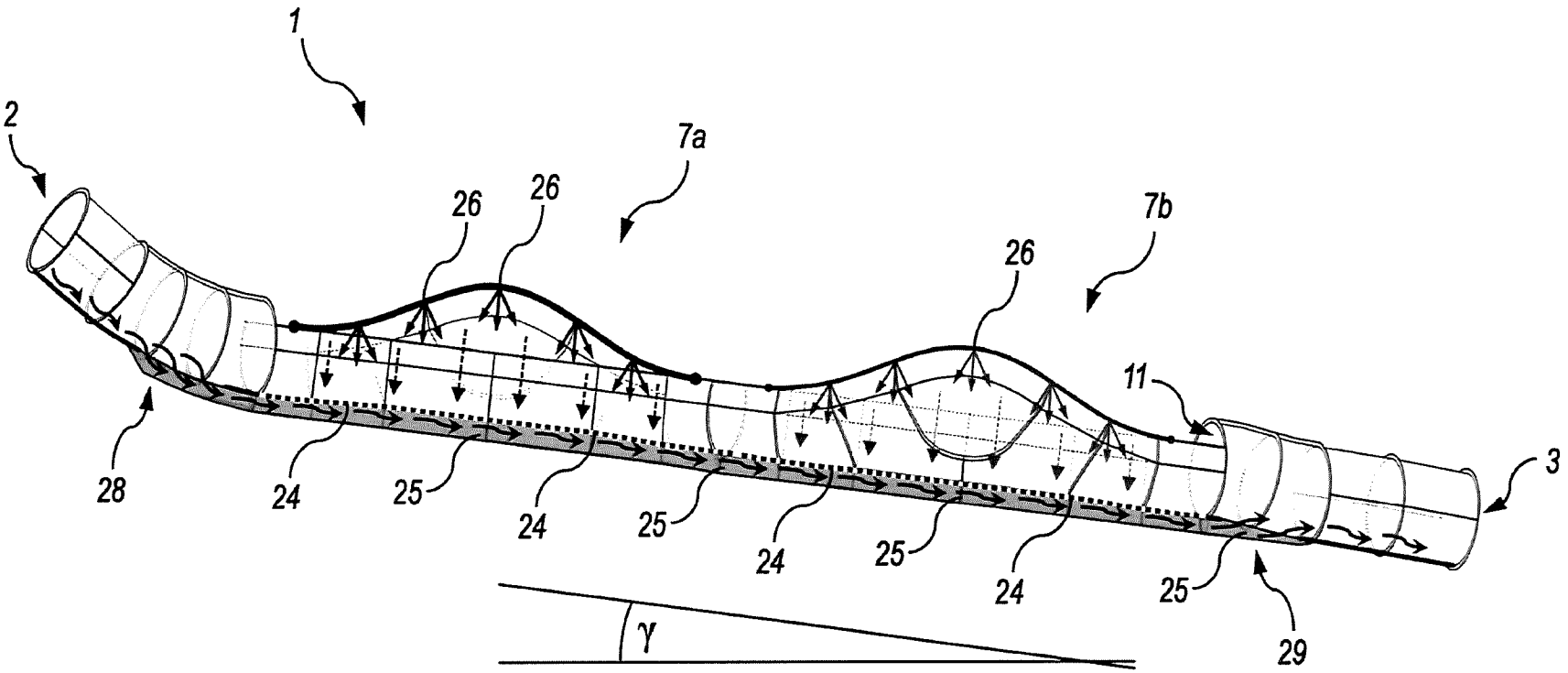

FIG. 8 elucidates that the stream of water running from the top 2 of the waterslide 1 down to the bottom 3 is more or less completely drained into the channel 25 through the water-draining holes 24 already starting before entry into the bend elements 7 as indicated by arrow 28. After the inventive bend elements 7*a* and 7*b* the stream of water is redirected to the flume 11 of the elements following the bend elements 7*a* and 7*b* as indicated by arrow 29.

Figure 9:
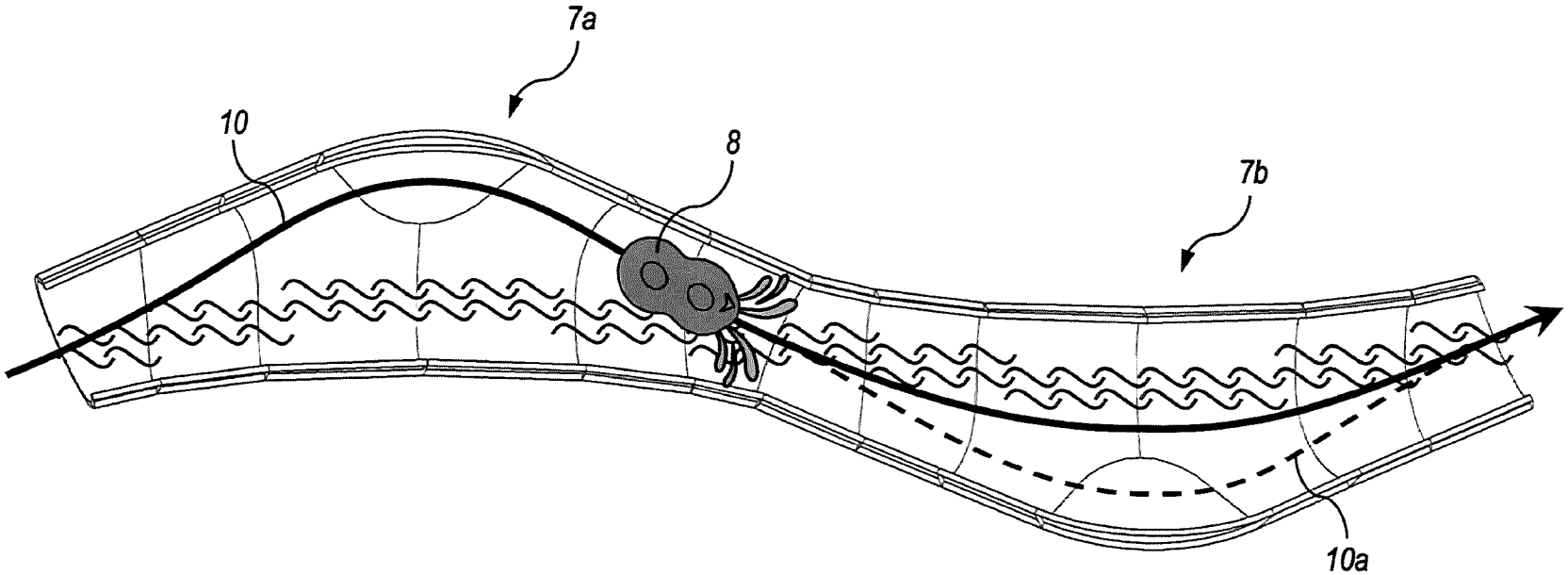

A situation of reentry into an existing stream of water in an inventive bend element without the water-draining holes 24 is shown in FIG. 9. It can be seen that a ride vehicle coming down from outside the stream of water is splashing into the slower stream of water thereby getting decelerated and consequently following the rather low ride path 10 which is not as high as the ride path 10*a* depicted by the dashed line. This is avoided, when the inventive bend elements are drained from the main stream of water by the drainage holes 24 as it is shown in FIG. 10 and only a thin film of water is provided by the irrigation elements 26.

FIG. 11 shows that a rider or ride vehicle 8 will follow different travel paths or ride paths 27*a* 27*b* and 27*c* depending on the travelling speed. While the depicted travel paths 27*b* and 27*c* lead high up into the region of increased radius (or a flat region of the bend element 7, if applicable when the increased radius becomes infinitely large), a slow riding speed will result in a lower travel path 27*a* which is more on the bottom of the flume 11.

FIG. 12 shows the alternative to an apex region with increased radius on its outer side 15 as compared to the inner side 14 of the bend element 7, where in the apex region 12 of the bend the bend element 7 has an asymmetric geometry in cross section, in which the cross section is flat on its outer side 15 and the cross section is curved at a radius on its inner side 14. Again, the bottom of the dish is inclined at an angle $\beta$ of about 45° to the horizontal at its highest location. This angle may, however, also be smaller or greater and values of 15° to 90° may commonly be provided for.

FIG. 13 shows the inventive waterslide 1 of FIG. 1 in perspective view. Naturally, some or all of the inventive bend elements 7*a* and 7*b* could be covered as are, for example the elements 5 and 6 at the beginning and the end of the waterslide 1. It can be seen that the transparent material M in the inventive bend element 7*a* allows for a view into the waterslide itself for people standing by.

In FIG. 14 it can be seen that the height of the flume on its outside reaches its maximum only after the apex region 12. In this view, dotted lines 30 denote roughly the outlie of the flume without this preferred feature.

The preferred embodiment of FIG. 15 has an increase in slope after the region of the apex 12, wherein this increase is denoted by reference numeral 31.

In all drawings, like elements are denoted by like reference numerals.

The invention claimed is:

1. Bend element for a flume-type waterslide, the bend element defining a bend with a bent sliding path for a rider between a bend-entry portion and a bend-exit portion of the bend element, wherein the bend element, in an apex region of the bend, has an asymmetric geometry in cross section, in which a radius in cross section is increased on its outer side, which increased radius is greater than a radius in cross section of the bend element on its inner side, wherein the bend-entry portion and the bend-exit portion have axes of entry into the bend and of exit from the bend that cross each other at an inner bend-angle of at least 90°, wherein in the cross section of the bend element, a vertical line intersecting a bottom of the bend element at its lowest point delimits the outer side from the inner side, characterized in that the cross section of the bend element, in the apex region, comprises an outer bottom section and an inner bottom section, wherein the outer bottom section extends from the lowest point in an outward direction to an outer point, in which the outer bottom section or its tangent line has an inclination of relative to a horizontal along the lowest point, and wherein the inner bottom section extends from the lowest point in an inward direction to an inner point that has the same distance from the lowest point, measured in the vertical direction, as the outer point, wherein a perpendicular distance between the outer point and the vertical line is larger by a factor of at least 1.2 than the perpendicular distance between the inner point and said vertical line.

2. The bend element according to claim 1, characterized in that the inner bend-angle is chosen between 100° and 160°.

3. The bend element according to claim 1, characterized in that the apex region on the outer side extends higher than a height of a flume in the bend-entry portion or the bend-exit portion and extends to at least twice the height as compared to a height of the flume in the bend-entry portion or the bend-exit portion.

4. The bend element according to claim 1, characterized in that the inner side of the bend element has a bend radius which is greater than a bend radius of an outer side of the bend element.

5. The bend element according to claim 1, characterized in that in the apex region the bend element is made from translucent material at least on the inner side of the bend element.

6. The bend element according to claim 1, characterized in that the bend element is made up of a plurality of segments of mirrored geometry with respect to a line extending from the apex region to a center of curvature (CC).

7. The bend element according to claim 6, characterized in that the apex region of the bend is made from a single segment arranged symmetrically between the segments of mirrored geometry.

8. The bend element according to claim 3, characterized in that the height of the flume on its outer side is maximum in a region following the apex region towards the bend-exit portion.

9. The bend element according to claim 1, characterized in that the bend element has an increase in slope (y) in a region extending from the region of the apex region towards the bend-exit portion.

10. The bend element according to claim 1, characterized in that the bend element has a plurality of water-draining holes in a bottom area thereof.

11. The bend element according to claim 1, characterized in that, at least one irrigation element is arranged on the outer side of the bend element.

12. A waterslide having at least one bend element as claimed in claim 1.

13. The bend element according to claim 1, wherein the outer bottom section or its tangent line has an inclination of 30° relative to the horizontal.

14. The bend element according to claim 13, wherein the outer bottom section or its tangent line has an inclination of 20° relative to the horizontal.

15. The bend element according to claim 1, wherein the perpendicular distance between the outer point and the vertical line is larger by a factor of at least 1.5 than the perpendicular distance between the inner point and said vertical line.

16. The bend element according to claim 2, wherein the inner bend-angle is chosen between 110° and 150°.

17. The bend element according to claim 16, wherein the inner bend-angle is chosen between 120° and 14020 .

18. The bend element according to claim 17, wherein the inner bend-angle is chosen at 135°.

19. The bend element according to claim 11, wherein the at least one irrigation element comprises a plurality of irrigation elements arranged on the outer side of the bend element.

* * * * *